US009353614B2

(12) United States Patent
Roth et al.

(10) Patent No.: US 9,353,614 B2
(45) Date of Patent: May 31, 2016

(54) FLUID HOMOGENIZER SYSTEM FOR GAS SEGREGATED LIQUID HYDROCARBON WELLS AND METHOD OF HOMOGENIZING LIQUIDS PRODUCED BY SUCH WELLS

(71) Applicant: Saudi Arabian Oil Company, Dhahran (SA)

(72) Inventors: Brian A. Roth, Dhahran (SA); Rafael Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 77 days.

(21) Appl. No.: 14/185,499

(22) Filed: Feb. 20, 2014

(65) Prior Publication Data

US 2015/0233228 A1 Aug. 20, 2015

(51) Int. Cl.

| | |
|---|---|
| ***E21B 43/34*** | (2006.01) |
| ***E21B 43/38*** | (2006.01) |
| ***E21B 43/12*** | (2006.01) |
| ***B01F 5/06*** | (2006.01) |
| ***B01F 3/04*** | (2006.01) |
| *B01F 3/00* | (2006.01) |

(52) U.S. Cl.

CPC ..... *E21B 43/38* (2013.01); *B01F 3/04503* (2013.01); *B01F 5/0615* (2013.01); *B01F 5/0689* (2013.01); *E21B 43/122* (2013.01); *E21B 43/128* (2013.01); *B01F 2003/0035* (2013.01)

(58) Field of Classification Search

CPC ..... B01F 3/04; E21B 43/38; E21B 43/122; E21B 43/128; E21B 41/0078; E21B 43/126; F04B 17/03; F04B 47/06; Y10T 137/0329

USPC ..... 166/105, 313, 177.7, 372; 261/77, 123; 417/410.1

See application file for complete search history.

(56) References Cited

U.S. PATENT DOCUMENTS

| | | | |
|---|---|---|---|
| 5,431,228 | A | 7/1995 | Weingarten |
| 5,482,117 | A | 1/1996 | Kolpak |

(Continued)

FOREIGN PATENT DOCUMENTS

| | | |
|---|---|---|
| EP | 1445420 | 8/2004 |
| WO | 2011119198 | 9/2011 |

OTHER PUBLICATIONS

International Search Report.

*Primary Examiner* — Duane Smith
*Assistant Examiner* — Minh-Chau Pham
(74) *Attorney, Agent, or Firm* — Abelman, Frayne & Schwab

(57) ABSTRACT

A system for and method for homogenizing the liquid and the gas and including providing a tube arrangement, first breaking up and separating the slugged gas from the liquid at a first location, and then gathering it into holding location—i.e., an annulus section of the flow tube—where it is re-introduced in controlled amounts into the liquid downstream of the first location. Various alternative gas/liquid separation devices are incorporated into the system which devices may be located either in a vertical wellbore or a horizontal wellbore, depending upon the particular well characteristics.

36 Claims, 6 Drawing Sheets

(56) References Cited

U.S. PATENT DOCUMENTS

| | | | | |
|---|---|---|---|---|
| 5,794,697 | A | 8/1998 | Wolflick | |
| 2007/0075447 | A1* | 4/2007 | Fernandes et al. | 261/77 |
| 2010/0300695 | A1* | 12/2010 | Brown et al. | 166/313 |
| 2013/0259721 | A1* | 10/2013 | Noui-Mehidi et al. | 417/410.1 |
| 2013/0341033 | A1* | 12/2013 | Carstensen | E21B 43/128 166/372 |
| 2014/0246206 | A1* | 9/2014 | Least | E21B 34/06 166/372 |
| 2015/0114632 | A1* | 4/2015 | Romer | E21B 4/003 166/250.15 |
| 2015/0167434 | A1* | 6/2015 | Mao | E21B 1/0078 166/372 |
| 2015/0226046 | A1* | 8/2015 | Wolf | E21B 43/126 166/372 |

* cited by examiner

FLUID HOMOGENIZER SYSTEM FOR GAS SEGREGATED LIQUID HYDROCARBON WELLS AND METHOD OF HOMOGENIZING LIQUIDS PRODUCED BY SUCH WELLS

BACKGROUND OF THE INVENTION

1. Field of the Invention

The present invention relates to a system and method for homogenizing production fluid from an oil well having gas slugging, for the purpose of improving the flow characteristics of the well.

2. Description of the Related Art

In long horizontal liquid wells with a gas cap, the gas may influx into the wellbore. As it travels the horizontal length, the gas tends to segregate and migrate upwardly from the liquid, collecting and forming high pressure gas bubbles generally referred to as gas slugs. As the well turns vertically at a heel portion and continues upwardly to the surface, the segregated gas will have a tendency to form large gas slugs in the liquid medium and possibly risk killing the well due to slugging flow, and upsetting the surface facilities and related systems.

Horizontal Wells

In long horizontal wells, the fluid flow has a tendency to segregate, with lighter fluids and gas drifting toward the top of the horizontal borehole and heavier liquids settling toward the bottom. At the heel of the well, the gas and liquids may be significantly segregated such that the segregated gas may be in slug form and provide an imbalance in the fluid lift, thereby potentially killing the well from flowing naturally. Remediation of the well would then be required to restart the well. In addition, the gas slugs passing through surface equipment can upset the surface facilities and related systems, thereby making it difficult to efficiently process the produced liquid hydrocarbons from the well.

Various arrangements for separating gas from production fluids in such wells downhole are known. For example, U.S. Pat. No. 5,431,228 relates to a downhole gas-liquid separator for wells, in which gas is separated from production liquids by way of a shaped baffle disposed in the well between the distal end of the production tubing string and the point of entry of gas and liquid into the wellbore. The gas and the liquid are then directed to the surface via separate flowpaths.

U.S. Pat. No. 5,482,117 is directed to a gas-liquid separator for use in conjunction with downhole motor driven pumps, particularly electric motor driven submersible pumps. A baffle is disposed in a tubular housing for separating gas from liquid.

Although such prior art systems represent attempts to separate gas from liquid downhole, the problems associated with gas slugging continues to hamper production in such gaseous slug-laden wells.

The present invention relates to a method and system of homogenizing the production fluid from such gaseous slug-laden wells, particularly wherein the gas slugging is at least in part due to the presence of one or more horizontal, or near horizontal boreholes communicating with the primary vertical borehole. A system for homogenizing production fluid from such wells is also disclosed.

SUMMARY OF THE INVENTION

In the description which follows, the expression "upstream" refers to the direction toward the downhole location of the well, and the expression "downstream" refers to the direction toward locations closer to surface.

The present invention relates to a system and method for improving the flow characteristics in such gas slugging wells. In particular, the method of the present invention passively separates the slugged gas from the fluid mix downhole, and then redirects the gas portion to a holding location in the form of an annulus, where the separated gas is then reinjected into the liquid column in a controlled method at a downstream location for the purpose of improving the homogeneity and flow characteristics of the production fluid. The injection of gas bubbles provides added lift to the liquid production, while improving the flow characteristics and reducing the risk of a "killed well". This procedure prevents the upset of the surface facilities, and increases the flow rate over that of a slug-flow regime.

The system of the present invention consists first of a means to separate slug or segregate gas from the fluid flow downhole, then to collect the segregated gas, and then to provide a controlled means for injecting the gas back into the liquid stream, such that the injected gas is more uniformly and homogeneously distributed through the liquid, thereby improving the flow characteristics of the liquid/gas medium.

One preferred embodiment of the invention consists of first providing a passive downhole gas/liquid separation device that is located in the vertical section of the well near the heel of the uppermost horizontal wellbore. Wellbore production fluid will flow into and up the casing, until the fluid reaches the gas/liquid separation device which is located at the bottom of the production string, and which defines an annulus with the casing. The gas/liquid separation device is so constructed and configured, that the liquid continues to flow upwardly through the production flow tube, and most of the gas accumulates within the annulus defined by the flow tube and the casing.

Although in one preferred embodiment of the present invention, the gas/liquid separation device is positioned in a vertical section of the well near the heel of the uppermost horizontal wellbore, the present invention also contemplates positioning the gas/liquid separator device in a horizontal section of the well, without departing from the scope of the invention.

As noted, according to one preferred embodiment of the present invention, the vertical section of the well is provided with a suitable well casing which communicates with the horizontal wellbore via a heel portion. An annular section, or annulus, is defined between a production tube and the well casing, with an annular sealing device positioned above the heel portion. The gas/liquid separation device can be located in a horizontal section of the well, wherein a similar annular section will be defined by the wellbore and the production tubing.

In one preferred embodiment, a passive gas/liquid separation device is located in a selected section of the well casing at the end of the string to passively separate the segregated gas portions from the liquid portions prior to directing most of the separated gas portion into the associated annulus section where it is held and permitted to rise upwardly.

When the passive gas/liquid separation device is located in the vertical wellbore, the gas rises upwardly in the annulus. Where the passive gas/liquid separation device is located in a horizontal wellbore, the gas in the annulus moves downstream toward the vertical wellbore and surface.

The separated gas portion in the annulus section is then dispersed back into the production tubing, preferably in controlled metered amounts to thereby result in the introduction of fine gas bubbles in the production fluid where it flows upwardly.

The gas/liquid separation device can be of any of several alternative configurations. One such preferred gas separation device can be in the form of a vertically oriented spiral shaped baffle disposed in a vertical section of the tubing.

The separation device can be in the form of a vertical flow tube located within the casing and provided with a series of tortuous apertures communicating between the annulus and the tubing, the apertures configured to permit passage of fluid into the tubing, while simultaneously causing the gaseous medium to rise in the annulus where it is ultimately re-introduced in a controlled manner, by injection or otherwise, into the production fluid.

At the bottom of the production string, the fluid (both liquid and gas) is at a pressure, $P_{gas/liquid}$. As noted, one such gas/liquid separation device includes a suitable mechanism, i.e., a spiral shaped device, or a flow tube having a series of tortuous paths, which paths strip the gas slugs from the liquid. Any of the alternative passive gas/liquid separation devices described herein can be used to separate the gas from the liquid. The gas will rise in the wellbore annulus and it will be trapped under an annular sealing device, such as a sealing packer located between the gas/liquid separation device and the casing. The pressure of the gas in the annulus, $P_{gas}$, will be very nearly the same pressure as $P_{gas/liquid}$ in the gas/liquid separation device. In this environment, any liquid mixed with the separated gas in the annulus will be re-directed from the annulus to the production flow tube and then proceed to flow naturally to the surface in the resultant homogeneous gas/liquid mix in the production string.

The pressure head of the liquid in the liquid/gas separation device decreases as it rises to the surface, due primarily to the change in hydrostatic head, according to Bernoulli's equation, as will be described in further detail hereinbelow. As noted, at a predetermined vertical distance upwardly from the central part of the gas/liquid separation device, $P_{gas}$ is greater than $P_{liquid}$, i.e., $P_{gas}>P_{liquid}$. The gas in the annulus below the annular sealing device will therefore be at a higher pressure than the pressure of the liquid at the same depth. Consequently, the gas in the annulus will then be directed through a gas lift valve or equivalent controlled gas injection device, and injected into the liquid production flow stream in the form of finely dispersed gas bubbles. The injection device allows one-way flow of gas from the annulus to the tubing of the gas/liquid separation device, preferably in a controlled manner, or at a metered rate, with $P_{gas}>P_{liquid}$.

The invention also envisions that if too much gas is produced in the gas/liquid separation step of the inventive method, it could kill the well during re-injection. Accordingly, the excess gas can be vented to the surface using a separate vent valve placed in the uppermost annular sealing packer, or at least in a proximal relation thereto.

It is also envisioned, that under certain conditions, an optional compressor can be accumulated in the annulus between the gas/liquid separation device and the annular sealing packer. The compressor can thereby provide additional pressure, if needed, to the separated gas positioned in the annulus, to assist re-entry of the gases into the production tubing. Moreover, if required, an electric submersible pump ("ESP"), can be positioned in the production flow tube below the point of re-injection of the fine gas bubbles, or in proximal relation thereto, to assist fluid production flow.

The system and method of the present invention not only eliminates the gas slugs which often inhibit well production, but also re-introduces the gas into the flow upstream via an injection device, thereby reducing the hydrostatic head in the flow, while providing additional lift to the output of the well.

It is within the scope of the present invention to incorporate any suitable passive method to separate the gas from the liquid downhole.

The Bernoulli Principle

The present invention relies on an application of the Bernoulli Principle as described hereinbelow.

Bernoulli's Principle is derived from the principle of conservation of energy and states that, in a steady-state flow, the sum of all forms of mechanical energy in a fluid along a streamline is the same at all points on that streamline. This requires that the sum of kinetic energy and potential energy remain constant. Thus, $$Z_1 + \frac{P_1}{\rho_1} + \frac{v_1}{2g} = Z_2 + \frac{P_2}{\rho_2} + \frac{v_2}{2g} + H_L;$$

where $$\frac{v_n}{2g}$$

goes to 0, where:

$Z_1$ is potential static pressure head (ft) at upstream location 1

$Z_2$ is potential static pressure head (ft) at downstream location 2

$P_1$ is pressure (lbs/in$^2$) at upstream location 1

$P_2$ is pressure (lbs/in$^2$) at downstream location 2

$\rho_1$ is density (lbs/in$^3$) at upstream location 1

$\rho_2$ is density (lbs/in$^3$) at downstream location 2

$v_1$ is flow velocity (ft/sec.) at upstream location 1

$v_2$ is flow velocity (ft/sec.) at downstream location 2 g is gravity constant (32.2 ft/s$^2$)

$H_L$ is loss of static pressure head due to flow (ft) (i.e., pressure losses from location 1 to 2 due to tubing wall friction), resulting in:

$$P_{1-2}=Z_{1-2}+H_L\times\rho_{1-2}$$

In particular, it can be seen from the above equation, that the difference in pressure between locations 1 and 2 is equal to the change in elevation/height, plus friction loss, multiplied by the change in density.

Alternatively, the equation may be written as follows:

$$P_{1-2}=Z_{2-1}+H_L*\rho_{1-2}$$

Thus the fluid pressure will be reduced due to a change in fluid elevation in the vertical section as well as head loss caused by friction during flow. The gas in the annulus will maintain a similar pressure at the gas separation location and under the annulus sealing packer.

Liquid Pressure and Height Using Water as an Example

Using water as an example, water undergoes a pressure increase of approximately 0.433 psi per ft. For 100 feet of vertical distance in a tube open to the atmosphere, the hydrostatic pressure at the bottom of the tube would measure about 43.3 psi. Gas, on the other hand, can be considered to have the same pressure over the entire distance of 100 ft. Therefore, if the gas is removed at the bottom of a 100 foot tubing at 43.3 psi, it would theoretically have the same pressure of 43.3 psi at the top of the tubing. Accordingly, the contained gas at the top of the tubing would be at 43.3 psi, while the liquid at the top of the tubing would be at 0 psi. Therefore the gas would tend to flow from the high pressure zone of the annulus to the lower pressure liquid zone in the tubing. The velocity of the liquid does not change at the two locations.

DETAILED DESCRIPTION OF THE PREFERRED EMBODIMENTS

A First Embodiment

Figures 1, 1A:
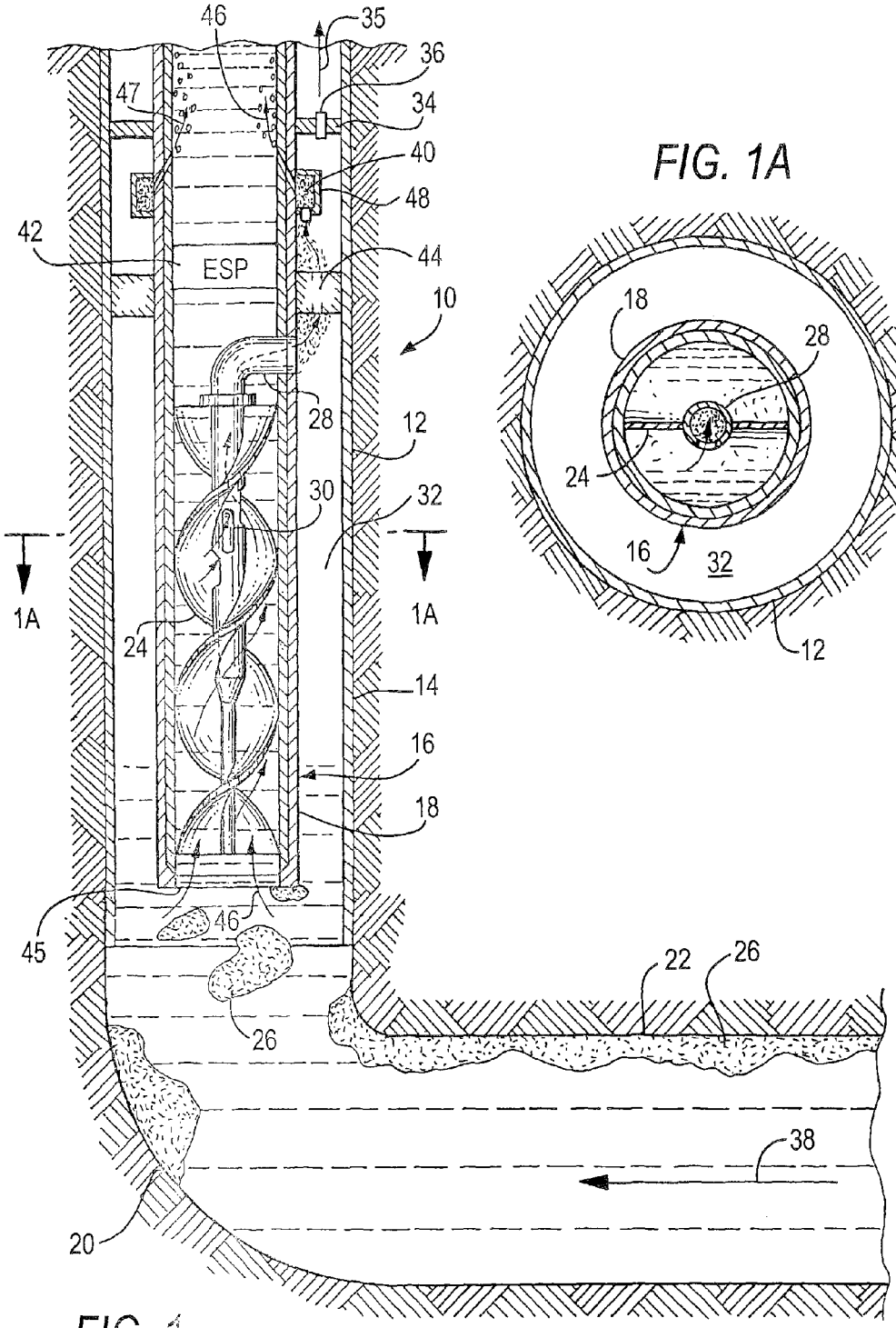
FIG. 1 is an elevational cross-sectional view of a vertical borehole, partially cased, and communicating with a horizontal borehole which merges with the cased vertical borehole at the heel of a well, illustrating a first embodiment of the invention for breaking up gas slugs into a plurality of smaller gaseous bubbles, and for re-introducing the bubbles into the production flow where they provide homogeneity and lift assist to the flow stream.
FIG. 1A is a cross-sectional view, taken along lines 1A-1A of FIG. 1.

Referring initially to FIG. 1, there is illustrated a system 10 constructed according to one preferred embodiment of the invention. According to this embodiment, the system 10 is installed in vertical wellbore 12 of a well, the wellbore 12 being lined with casing 14.

The system 10 includes a passive gas/liquid separation device 16 in the form of flow tube 18 which is located above the heel portion 20 of the well, which heel portion 20 connects the vertical wellbore 12 with a generally horizontal borehole 22.

The fluid flow 38 (i.e., liquid, gas slugs and water) from horizontal borehole 22 reaches the heel 20 as shown, and rises upwardly in the vertical casing where it meets the flow tube 18. At this location, the fluid enters the vertical flow tube 18 and proceeds upwardly along the spiral path defined by spiral baffle 24.

The system of FIG. 1 includes one preferred form of gas/liquid separation device 16 in the form of spiral baffle, or auger 24, positioned in flow tube 18 and defining a spiral path for the gas/liquid mix rising from the horizontal borehole 22. The spiral shaped path of baffle 24 tends to separate the gas slugs 26 from the liquid medium by centrifugal forces imposed on the liquid, which forces cause the liquid portion to migrate radially outwardly from the center of baffle 24, as the mix rises and increases in velocity. The lighter gas portion will remain closer to the center and enter central gas tube 28 via apertures 30, to be directed into the annulus 32 defined between flow tube 18 and casing 14. The gas portion in the center of baffle 24 may include a relatively lesser portion of liquid in the mix.

As noted, as the gas/liquid mix rises up the spiral path of the gas/liquid separation baffle 24, the heavier liquid portion migrates outwardly along the spiral path, and the gaseous portion enters apertures 30 in the center of the spiral baffle 24 and is directed into annulus 32.

Annular packer 34 is provided with vent valve 36, which is adapted to vent excess gas to the atmosphere in the event an excessive amount of gas is produced and accumulated in the annulus 32 to form a high pressure zone.

In particular, as can be seen from the FIGURES, liquid will enter the annulus 32; however a reduced flow rate due to a large "settling area" will allow the liquid and gas to separate by density differences. The separated liquid will be directed to the tubing, the gas will remain in the annulus, captured under the packer until reinjected into the tubing.

It will be appreciated that the combination of the continuous rotational path of the fluids while traveling upwardly along the spiral path, and the progressively increasing velocity of the fluids as they rise upwardly, will cause radially outward migration of the heavier liquids (i.e., oil and water) and retention of the most gaseous phase closer to the center as shown by arrow 23. Simultaneously, by the action of the spiral path, the gaseous slugs 26 will be broken up into smaller bubbles, which enter central gas flow tube 28 via inlet aperture(s) 30.

Thereafter, as noted, the liquid phase of oil (sometimes combined with water) will proceed upwardly into production flow tube 18, while the gaseous phase in the form of relatively smaller bubbles will migrate upwardly, or will be lifted by compressor 44 (if required) and then proceed to injection device 40, which allows one-way flow of gas from annulus 32 into production flow tube 18, preferably in a controlled manner, where the gases are mixed with the liquid phase in a dispersed and uniform manner. In the flow tube 18, an optional electric submersible pump 42 can also be installed in flow tube 18 as shown in phantom lines in FIG. 1, to assist the production flow upward toward surface if required by the conditions prevailing in the well.

Annular packer 34 will contain the mostly gaseous medium formed by the dispersed slugs, if and until the pressure exceeds the pre-set pressure of relief valve 36. Should the pre-set pressure be exceeded, the relief valve 36 will permit the gaseous medium to escape into the annulus and rise to the surface as illustrated schematically by the arrow 35 shown in phantom lines.

In FIG. 1, injection device 44 is positioned in the annulus 32 as shown, and arranged to communicate with the production flow tube 18 such that gas exiting central gas tube 28 can be directed into the annulus 32, and then into the production flow tube 18 in a controlled manner and the form of relatively fine bubbles, at an elevated location immediately below packer 34. Thereafter, the merged fine gas bubbles and the production liquid mix is allowed to flow to elevated locations above packer 34 and proceed upwardly to the wellhead at the earth's surface.

As noted, depending upon the particular characteristics and conditions in the well, an optional compressor 44 can be positioned as shown in FIG. 1, in the annulus 32 to assist the upward movement of the predominantly gaseous medium exiting central gas tube 28 and entering annulus 32 via apertures 30. Compressor 44 comprises an artificial lift system that electrically drives multiple centrifugal stage impellers to increase the pressure and thereby lift the predominantly gaseous medium from annulus 32. The compressor 44 may be powered by electric power provided from the surface. Depending upon the circumstances and well completion conditions, the compressor can be in any of several forms.

The steps of diffusing the gaseous slugs into predominantly fine gas particles, and then re-introducing them into the predominantly liquid phase of the production flow increases the flow rate of the produced fluid stream and maintains the continuous operational characteristics of the well.

It is also noted that the assist provided by the optional compressor 44 promotes improved merging of the now dispersed gaseous medium with the predominantly liquid flow in the production flow tube 18.

As shown in FIG. 1, an electric submersible pump 42 can optionally be positioned in production flow tube 18 above compressor 44 to provide artificial lift to the predominantly liquid medium in flow tube 18.

In FIG. 1, the production flow tube 18 is open at the mouth 45 to receive fluids as depicted by arrows 46.

In FIG. 1, the fluid (both liquid and gas) at the mouth 45 of the flow tube 18 would generally be at a first pressure, designated as $P_{gas/liquid}$. Once the flow of liquid and gas slugs enters the flow tube 18 and gas/liquid separation device 16 as shown in FIG. 1, and the separation of the gas from the liquid takes place by the gas passing through the path of spiral baffle or auger 24, the gas will rise in the wellbore annulus 32 and it will be ultimately trapped therewithin under an annular sealing device, such as packer 34, or the like.

Since the pressure $P_{gas}$ of the gas in the annulus 32, prior to re-entry into the flow tube 18, by injection device 40, is greater than the liquid pressure $P_{liquid}$ in the flow tube 18, any relatively small amount of liquid in the annulus 32 will be redirected from the annulus 32 into the flow tube 18, and then flow naturally within the flow tube 18 toward the surface in flow tube 18 along with the production flow.

As the liquid rises in the flow tube 18, the hydrostatic pressure will decrease primarily due to the change in height. As noted, the pressure of the liquid will be different at the various locations in the tubing string and an upper location will have a lower pressure than a deeper location as will be explained hereinbelow, using water as an example.

Referring again to FIG. 1, at a predetermined vertical distance above the mouth 44 of flow tube 18, $P_{gas}$ will be greater than $P_{liquid}$. At this location, the primarily gas flow in the annulus 32 below the packer 34 will be at a higher pressure than that of the medium in the flow tube 18, which is comprised primarily of a liquid. The gas will then be directed via a controlled gas injection device 40 for injection into the liquid stream. As noted, the gas injection device 40 will control the rate of gas injection into the flow tube 18, as shown schematically by arrows 46 in FIG. 1.

The gas injection device 40 is a valve used in a gas lift system which controls the flow of lift gas into the production tubing conduit in a controlled manner. The gas injection device 40, which can be in the form of an injection valve, is located in a gas lift mandrel 48, which also provides communication with the gas supply in the tubing annulus 32. Gas lift mandrel 48 is a device installed in the tubing string and is shown schematically in FIG. 1. Operation of the gas injection device 40 is determined by preset opening and closing pressures in the tubing of the annulus, depending upon the specific application.

The gas lift injection device 40 or other suitable gas injection controlled metering device, or nozzle is preferably capable of providing specifically controlled metered gas flow into the liquid stream in the flow tube 18 in a manner to produce finely dispersed gas bubbles in the liquid stream. In particular, the gas injection device 40 allows one-way flow of gas from the high pressure zone of annulus 32 into flow tube 18, as explained previously, due to the fact that $P_{gas}$ is greater than $P_{liquid}$ at such elevated location. Any relatively small amount of liquid which is mixed with the gas in the annulus 32 will naturally flow back into the flow tube 18 through gas injection device 40. Injection device 40 preferably will be arranged to re-inject the gas into the tubing at the same rate that it is stripped out of the liquid/gas flow by the passive gas separation process of gas/liquid separation device 16.

A venting device such as vent valve 36, is positioned preferably within the packer 34 to vent excess gas to the atmosphere in the event such an excessive amount of gas is produced and accumulated in the annulus 32 to form a high pressure zone. Therefore, if the gas is not reinjected at the same rate that it is stripped, the gas will fill the annulus 32 until it reaches the stripped pressure. The passive gas/liquid separation system will no longer strip out the gas; rather the gas will stay in solution with the liquid and will be injected into the tubing.

A Second Embodiment

Figure 2:
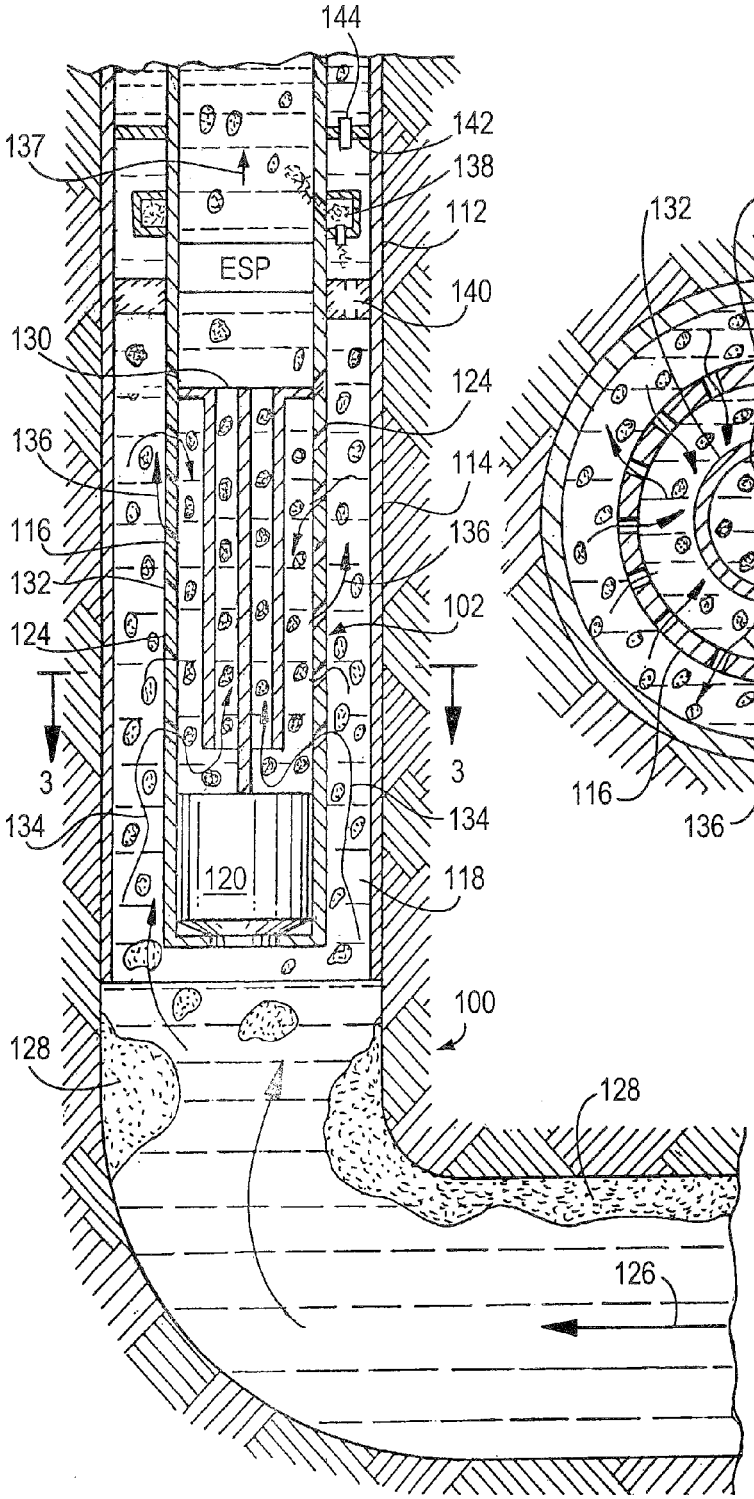
FIG. 2 is a cross-sectional view of a lower portion of a vertical section of a cased borehole similar to FIG. 1, incorporating alternative embodiment of a passive gas/liquid separation device according to the invention, for eliminating gas slugging and for improving the fluid flow upstream, the passive gas/liquid separation device shown being in the form of a flow tube, plugged at the lowermost end, and provided with a plurality of tortuous paths for entry of liquid into the flow tube, while permitting the gas slugs to be stripped out and move up the annulus.
Figure 3:
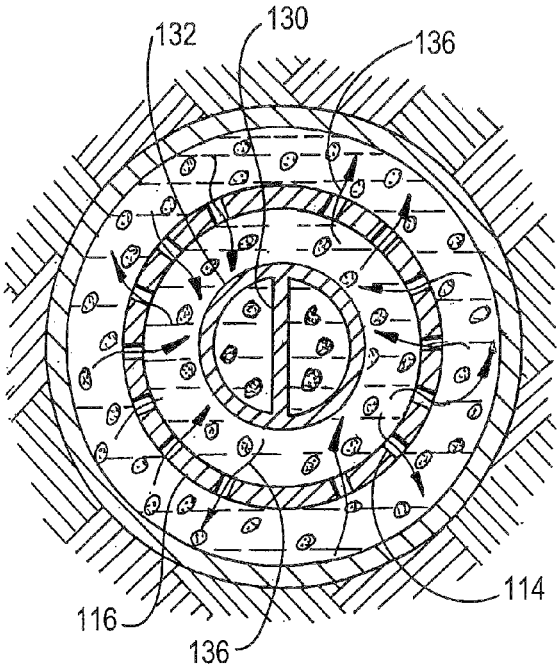
FIG. 3 is a cross-sectional view, taken along lines 3-3 of FIG. 2.

Referring now to FIGS. 2-3, there is illustrated an alternative embodiment 100 of the inventive system, which includes passive gas/liquid separation device 102 in the form of flow tube 116. Wellbore 112 is lined with casing 114 in which flow tube 116 is positioned to form annulus 118 with casing 114, as shown. In this embodiment, flow tube 116 is closed at its lowermost end by plug 120. In principle, the operation of the embodiment of FIGS. 2 and 3 differs from the previous embodiment, but the objectives and results are similar. The tortuous apertures 124 in flow tube 116 receive and direct the liquid 126 containing gaseous slugs 128 into the flow tube 116 as shown, while the major portion of the gaseous medium is permitted to move upwardly into annulus 118 via apertures 124. The flow tube 116 includes a central separator baffle 130 for further assistance and guidance of the liquid medium, the central baffle 130 being surrounded by circular baffle 132 as shown in FIGS. 2 and 3. Major portions of the gaseous slugs 128 are broken up while entering the flow tube 116 via tortuous apertures 124, which are so configured as shown, as to encourage the liquid component to enter the circular baffle 132, as shown schematically by arrows 134. The gaseous medium is "encouraged" to move upwardly and outwardly toward annulus 118 as depicted schematically by arrows 136, and the predominantly liquid flow is depicted by arrow 137.

FIG. 3 is a cross-sectional view taken along lines 3-3 of FIG. 2, illustrating the escape of gaseous medium by arrows 136 which were previously in the form of gaseous slugs 128, via tortuous apertures 124 and into annulus 118. In particular, a controlled gas injection device 138 is positioned above compressor 140 and below packer 142, which is provided with vent valve 144 as in the embodiment of FIGS. 1 and 2.

In all other respects, the uppermost structure and operation of the embodiment of FIGS. 2 and 3 are the same as the operation of the previous embodiments.

A Third Embodiment

Figure 4:
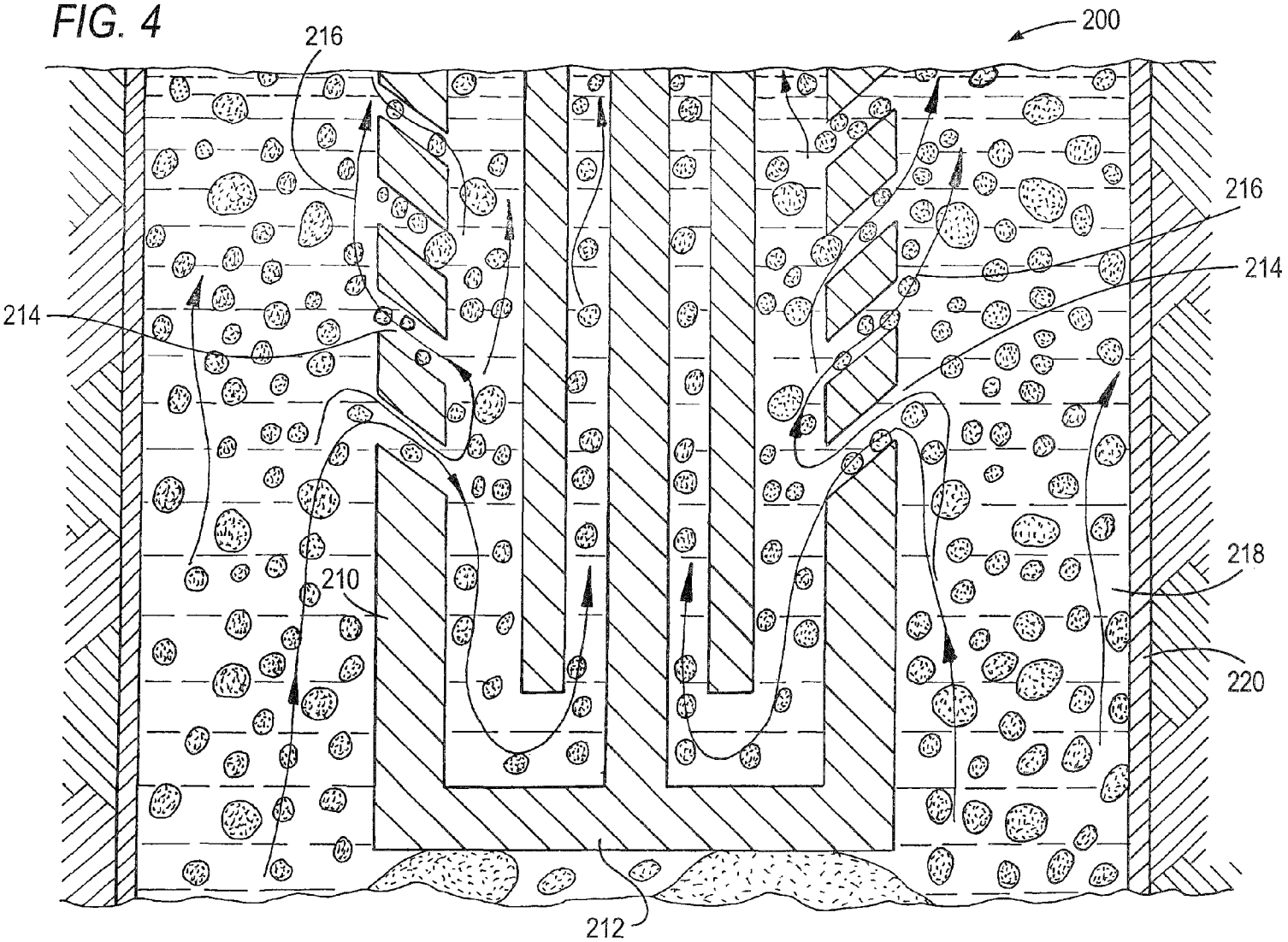
FIG. 4 is an enlarged cross-sectional view of a lower portion of yet another embodiment of the invention similar to FIGS. 2 and 3, incorporating a flow tube closed at the lowermost distal end by an integral bottom wall, and including an internal baffle system which produces tortuous paths for separating the gas slugs and breaking them up into small bubbles.

Referring now to FIG. 4, there is illustrated an enlarged cross-sectional view of a lowermost portion of yet another alternative embodiment 200 of the invention, in which the flow from a horizontal borehole of the well enters the tube 210, which is closed at its lowermost end by integrally formed base plate 212, the flow tube 210 including apertures 214 which create respective tortuous paths as depicted by arrows 216, for separation of the gas from the liquid. This path causes the gas slugs to be broken up and to be stripped from the liquid while entering the annulus 218 formed between the flow tube 210 and the casing 220. The gas is thus stripped from the liquid/gas mix and then permitted to accumulate in the annulus 218, where it is reinjected into the flow tube 210 at the upper end (not shown in FIG. 4) in the same manner as described in connection with the previous embodiments.

In all other respects, the operation and the remaining structure and function of the embodiment of FIG. 4, are the same as with the previous embodiments.

A Fourth Embodiment

Figure 5:
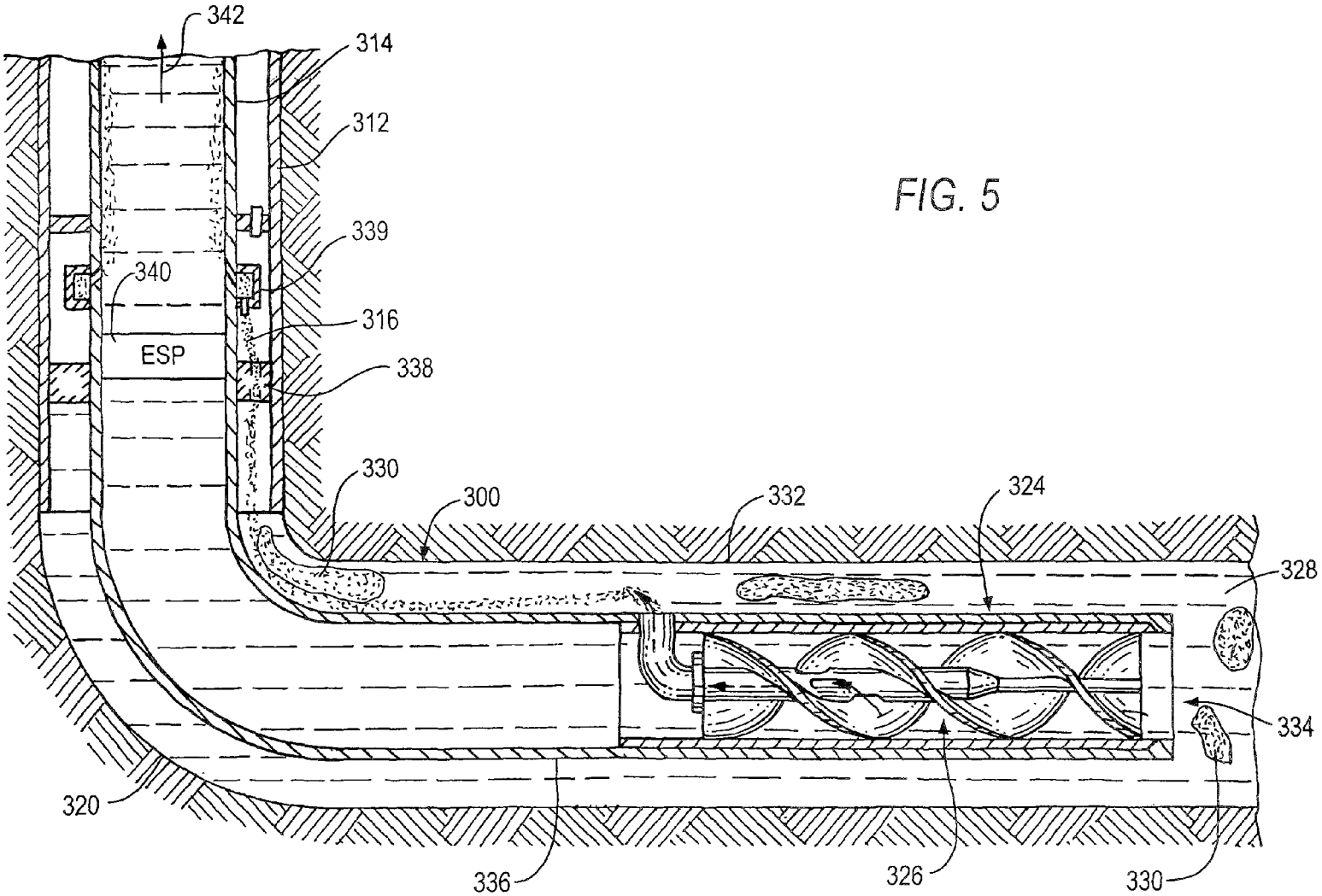
FIG. 5 is an elevational cross-sectional view of a wellbore similar to the previous FIGURES, showing an alternative embodiment of the invention, wherein the passive gas/liquid separation device of FIG. 1 is located in the horizontal borehole.

Referring now to FIG. 5, there is shown yet another alternative embodiment 300 of the invention, in which the passive gas/liquid separation device 324 is positioned in the horizontal borehole of the well. The system of FIG. 5 is similar in most respects to the gas/liquid separation device system of FIGS. 1 and 2, except that it is located in the horizontal borehole.

The well completion system 300 is comprised of vertical borehole 310 provided with vertical casing 312 surrounding production flow tube 314 to form annulus 316.

Horizontal borehole 322 is depicted schematically as being joined with vertical borehole 310 at heel 320. Located in horizontal borehole is a passive gas/liquid separation device 324, which is structurally and functionally identical to the passive gas/liquid separation device shown in FIGS. 1 and 2, including a spiral shaped baffle or auger 326 positioned and adapted to receive gaseous slug-laden fluids from the well through the horizontal borehole 322, as depicted by arrows 328 and slugs 330.

The slug-laden fluids depicted by arrows 328 enter mouth 334 of the gas/liquid separation device 324 and proceed downstream to passively separate the gas components from the liquid components while breaking up the gaseous slugs into relatively smaller pluralities of bubbles.

As in the system of FIGS. 1 and 2, the gaseous slugs are broken up into smaller bubbles and exit flow tube 336. Thereafter the primarily gaseous medium is assisted by compressor 339 if needed, and then injected into vertical flow tube via controlled injection device 338 where it is mixed with the predominantly liquid medium passing through spiral shaped baffle or auger 326 as in the system disclosed in FIGS. 1 and 2.

The now homogeneous liquid/gas mixture flows with the assistance of electric submersible pump (designated as "ESP") 340 and then to vertical flow tube 314 where it proceeds upwardly through surface as shown by arrow 342.

In all other respects, the operation of this embodiment is the same as the previous embodiments.

A Fifth Embodiment

Figure 6:
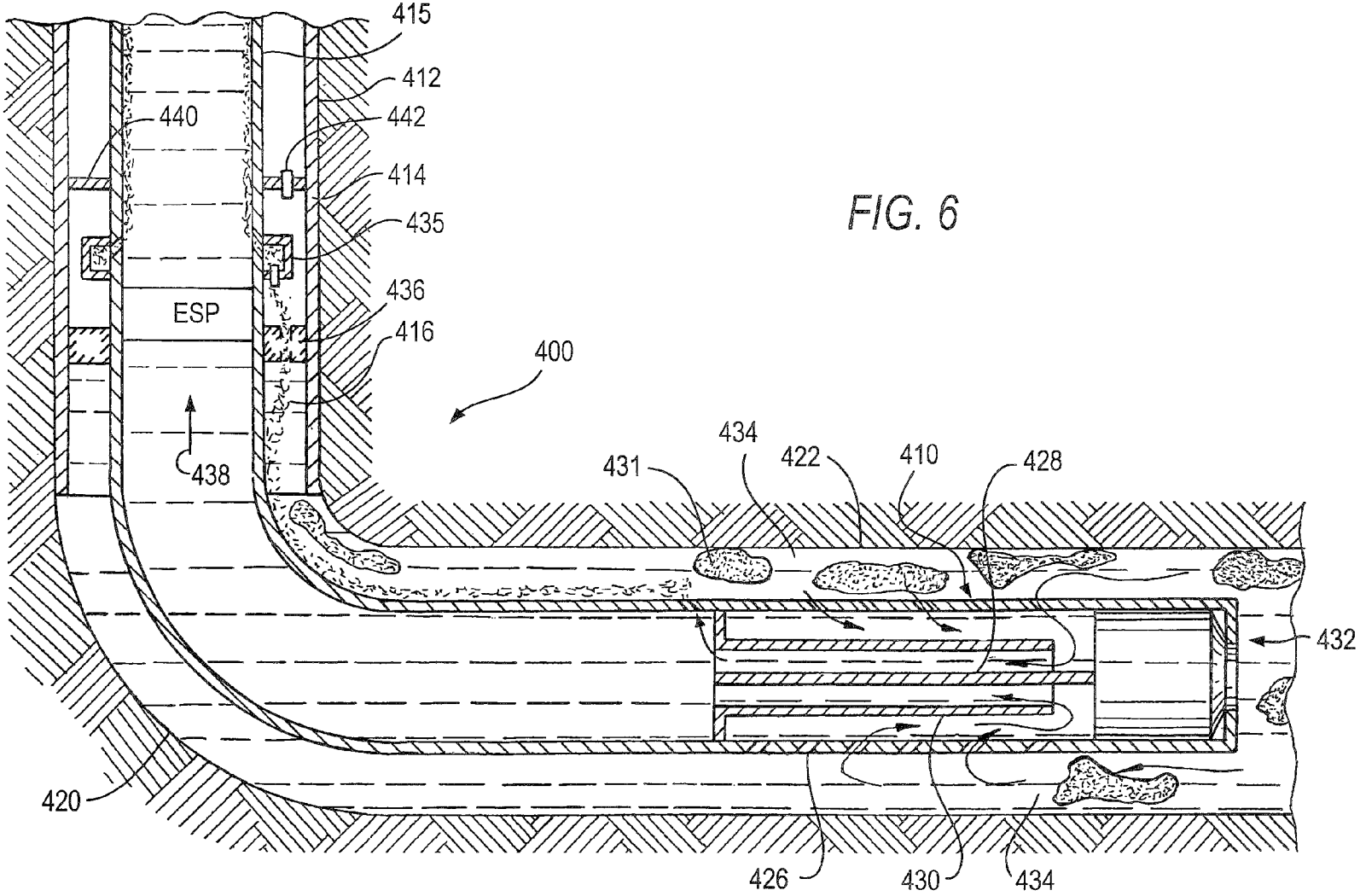
FIG. 6 is an elevational cross-sectional view of a wellbore similar to the previous FIGURES, showing an alternative embodiment of the invention, wherein the passive gas/liquid separation device of FIG. 2 is located in the horizontal borehole.

Referring now to FIG. 6, there is shown yet another alternative embodiment 400 of the invention, in which the passive gas/liquid separation device 410 is positioned in the horizontal borehole of the well. The passive gas/liquid separation device 410 of this system is similar to the system of FIGS. 2, 3 and 6.

System 400 is comprised of a vertical borehole 412 provided with vertical casing 414 surrounding production flow tube 415 to form annulus 416.

Horizontal borehole 422 is depicted schematically as being joined with vertical borehole 414 at heel 420. Located in horizontal borehole 422 is a passive gas/liquid separation device 410 which is structurally and functionally identical to the passive gas/liquid separation device shown in FIGS. 2, 3 and 5, including flow tube 426 containing central baffle 428 surrounded by circular baffle 430.

As described in connection with the embodiment of FIGS. 2 and 3, the slug-laden fluids proceed from the well through horizontal borehole 422 as shown schematically by arrows 432. As the fluids flow through the horizontal borehole 422, the gaseous slugs 431 are made to pass through a series of tortuous paths where they are divided into a plurality of relatively smaller bubbles as the slugs are dispersed. The mostly gaseous medium then migrates toward annulus 434 and toward compressor 436, and is then injected under controlled conditions by injection device 435 into the flow tube 426 where a homogeneous mix 438 of liquid and relatively smaller gas bubbles is produced.

Annulus packer seal 440 is positioned in the annulus and includes having a release vent valve 442 which permits release of the predominantly gaseous media in the event the pressure rises in annulus 434 exceeds a pre-set value.

The resultant homogeneous mixture depicted by arrow 438 is then directed to surface.

In all other respects, the passive gas/liquid separation system shown in FIG. 6 is structurally and functionally the same as the corresponding system of FIGS. 2 and 3.

Figure 7:
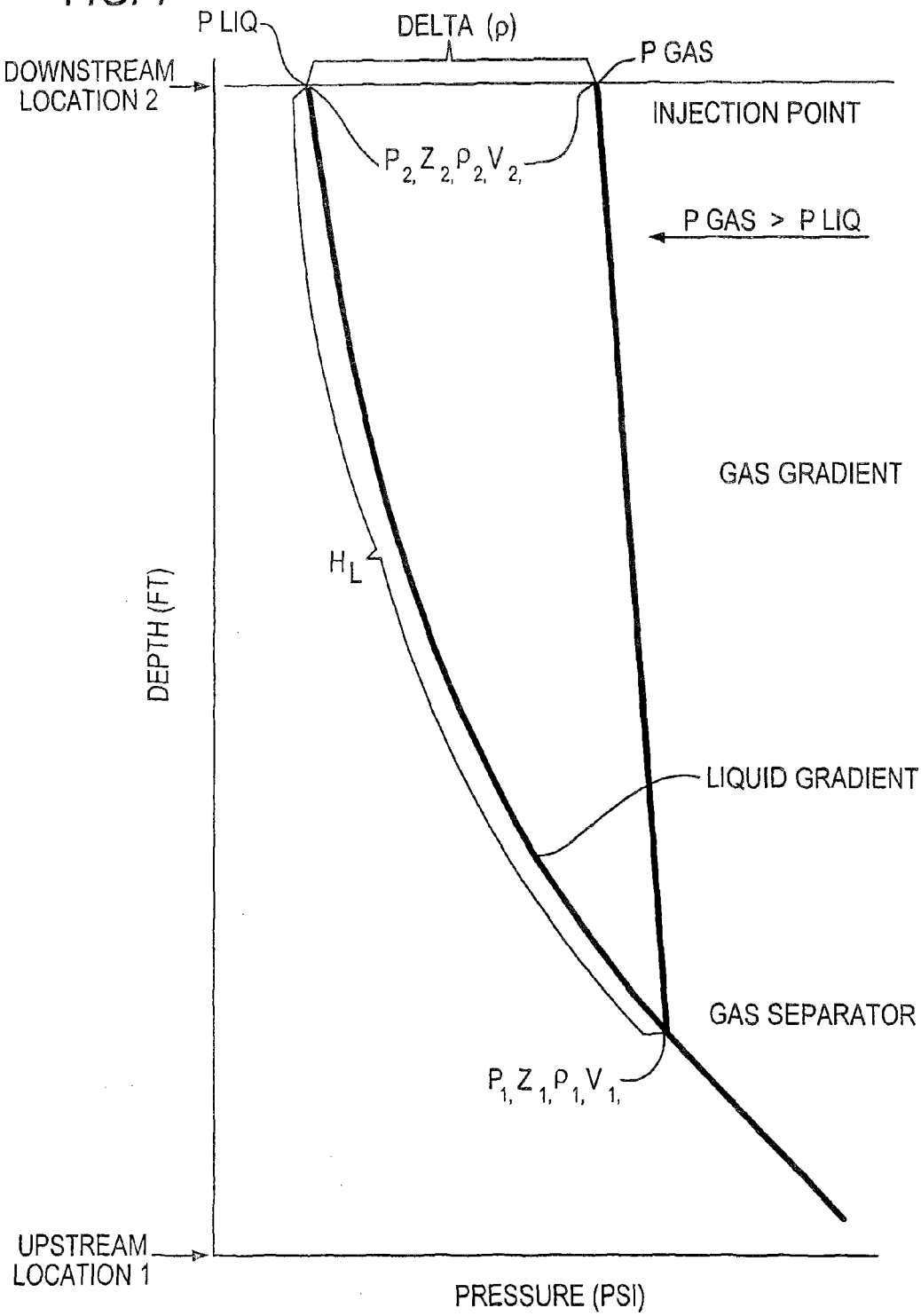
FIG. 7 is a graph which illustrates the liquid and gas pressures in relation to the depth of the well, in feet, for the embodiments of the present invention.

FIG. 7 is a graph which illustrates the liquid and gas pressures in relation to the depth of the well, in feet, for the embodiments of FIGS. 1-6. In particular, the liquid and gas conditions at two different depth locations identified respectively as "upstream location 1" and "downstream location 2" are shown in the graph.

LIST OF REFERENCES

| | | |
|---|---|---|
| 10 | System | FIG. 1, FIG. 1A |
| 12 | Vertical Wellbore | FIG. 1, FIG. 1A |
| 14 | Casing | FIG. 1, FIG. 1A |
| 16 | Gas/Liquid Separation Device | FIG. 1, FIG. 1A |
| 18 | Flow Tube | FIG. 1, FIG. 1A |
| 20 | Heel Portion | FIG. 1, FIG. 1A |
| 22 | Horizontal Borehole | FIG. 1 |
| 23 | Arrow | FIG. 1 |
| 24 | Spiral Baffle, or Auger | FIG. 1, FIG. 1A |
| 26 | Gaseous Slugs | FIG. 1, FIG. 1A |
| 28 | Central Gas Flow Tube | FIG. 1, FIG. 1A |
| 30 | Apertures in Gas Tube 28 | FIG. 1 |
| 32 | Wellbore Annulus | FIG. 1, FIG. 1A |
| 34 | Annular Packer | FIG. 1 |
| 35 | Arrow | FIG. 1 |
| 36 | Vent Valve | FIG. 1 |
| 38 | Fluid Flow (i.e., liquid, gas slugs and water) | FIG. 1 |
| 40 | Gas Injection Device | FIG. 1, FIG. 1A |
| 42 | Optional Electric Submersible Pump | FIG. 1 |
| 44 | Compressor | FIG. 1 |
| 45 | Mouth of Flow Tube 18 | FIG. 1 |
| 46 | Arrows Depicting Fluid Flow | FIG. 1 |
| 47 | Arrows Depicting Gas Flow | FIG. 1, FIG. 1A |
| 48 | Gas Lift Mandrel | FIG. 1 |
| 100 | Alternative Embodiment | FIGS. 2, 3 |
| 102 | Gas/Liquid Separation Device | FIGS. 2, 3 |

-continued

| LIST OF REFERENCES | | |
|---|---|---|
| 112 | Wellbore | FIGS. 2, 3 |
| 114 | Casing | FIGS. 2, 3 |
| 116 | Flow Tube | FIGS. 2, 3 |
| 118 | Annulus | FIGS. 2, 3 |
| 120 | Plug | FIGS. 2, 3 |
| 124 | Tortuous Apertures | FIGS. 2, 3 |
| 126 | Liquid Flow | FIG. 2 |
| 128 | Gaseous Slugs | FIG. 2 |
| 130 | Central Separator Baffle | FIG. 2 |
| 132 | Circular Baffle | FIG. 2 |
| 134 | Arrows Depicting Fluid Flow | FIG. 2 |
| 136 | Arrows Depicting Gaseous Flow | FIG. 2 |
| 137 | Liquid Flow | FIG. 2 |
| 138 | Gas Injection Device | FIG. 2 |
| 140 | Compressor | FIG. 2 |
| 142 | Packer | FIG. 2 |
| 144 | Vent Valve | FIG. 2 |
| 200 | Another Alternative Embodiment | FIG. 4 |
| 210 | Flow Tube | FIG. 4 |
| 212 | Base Plate of the Flow Tube | FIG. 4 |
| 214 | Apertures in Flow Tube | FIG. 4 |
| 216 | Arrows Depicting Gaseous Flow | FIG. 4 |
| 218 | Annulus | FIG. 4 |
| 220 | Casing | FIG. 4 |
| 300 | Alternative Embodiment/System | FIG. 5 |
| 310 | Vertical Borehole | FIG. 5 |
| 312 | Vertical Casing | FIG. 5 |
| 314 | Vertical Production Flow Tube | FIG. 5 |
| 316 | Annulus | FIG. 5 |
| 318 | Packer Seal | FIG. 5 |
| 320 | Heel | FIG. 5 |
| 322 | Horizontal Borehole | FIG. 5 |
| 324 | Gas/Liquid Separation Device | FIG. 5 |
| 326 | Spiral Shaped Baffle or Auger | FIG. 5 |
| 328 | Arrows | FIG. 5 |
| 330 | Slugs | FIG. 5 |
| 334 | Mouth of Gas/Liquid Separation Device | FIG. 5 |
| 336 | Flow Tube | FIG. 5 |
| 338 | Compressor | FIG. 5 |
| 339 | Gas Injection Device | FIG. 5 |
| 340 | Electric Submersible Pump ("ESP") | FIG. 5 |
| 342 | Arrows Depicting Homogeneous Fluid Flow | FIG. 5 |
| 400 | Alternative Embodiment - System | FIG. 6 |
| 410 | Passive Gas/Liquid Separation Device | FIG. 6 |
| 412 | Vertical Borehole | FIG. 6 |
| 414 | Vertical Casing | FIG. 6 |
| 415 | Vertical Flow Tube | FIG. 6 |
| 416 | Annulus | FIG. 6 |
| 418 | Optional Packer Seal | FIG. 6 |
| 420 | Heel | FIG. 6 |
| 422 | Horizontal Borehole | FIG. 6 |
| 426 | Horizontal Flow Tube | FIG. 6 |
| 428 | Central Baffle | FIG. 6 |
| 430 | Circular Baffle | FIG. 6 |
| 431 | Gaseous Slugs | FIG. 6 |
| 432 | Arrows Depicting Fluid From Well | FIG. 6 |
| 434 | Annulus | FIG. 6 |
| 435 | Injection Device | FIG. 6 |
| 436 | Compressor | FIG. 6 |
| 438 | Arrows Depicting Homogeneous Mix | FIG. 6 |
| 440 | Packer Seal | FIG. 6 |
| 442 | Release Vent Valve | FIG. 6 |

The invention claimed is:

1. A method of homogenizing production fluid from an oil well having one or more wellbores, the method comprising:

a) directing production fluid through a predetermined initial flow path as the production fluid enters a section of a wellbore to passively separate gas from the production fluid to produce a predominantly gaseous medium and a predominantly liquid medium;

b) directing the separated gas into an annulus section formed within the section of wellbore, said annulus section including an annular sealing device spaced downstream from the initial flow path of the production fluid;

c) directing the predominantly liquid medium of the production fluid to a production flow tube communicating with surface; and d) dispersing the separated gaseous medium in the annulus section into the flow tube in a controlled manner and upstream of the annular sealing device to form a relatively homogeneous mixture of liquid and fine gas bubbles downstream of the annular sealing device.

2. The method of claim 1, further comprising operating an electric submersible pump located in the flow tube to augment the flow of the homogeneous production fluid.

3. The method of claim 2, wherein a gas/liquid separation device comprises a tortuous flow path located in the wellbore.

4. The method of claim 3, wherein the tortuous flow path comprises a spiral baffle.

5. The method of claim 3, wherein the tortuous flow path comprises an auger which defines a spiral path.

6. The method of claim 3, wherein the tortuous path is provided by a flow tube, plugged at the fluid receiving end and provided with baffles and tortuous apertures to separate a gaseous portion of the production flow from the liquid portion.

7. The method of claim 1, wherein the step of dispersing the separated gas from the annulus section into the flow tube is accomplished by a controlled injection device.

8. The method of claim 1, further comprising directing at least a portion of the separated gas from the annulus through the annular sealing device via a pressure relief mechanism when a predetermined gas pressure is reached in the annulus.

9. The method of claim 1 wherein said gas/liquid separation flow path is in a vertical wellbore of the well.

10. The method according to claim 1 wherein said gas/liquid separation flow path is in a horizontal wellbore of the well.

11. A method of homogenizing production fluid from an oil well having one or more horizontal wellbores communicating with a vertical wellbore section, the method comprising:

a) directing production fluid from the horizontal wellbore into the vertical wellbore section and through a tortuous flow path defined by a gas/liquid separation device positioned in the vertical or horizontal wellbore section of the well near a heel portion of the horizontal wellbore, to thereby separate gas from the production fluid, while permitting the liquid portion of the production fluid to flow downstream toward surface;

b) directing the separated gas into an annulus section formed within the vertical or horizontal wellbore section of the well casing; and c) injecting the separated gas into the liquid portion to produce a homogeneous mix as it flows upwardly toward surface above the annular sealing device.

12. The method of claim 11, further comprising operating an electric submersible pump located in a well section between the tortuous flow path and the surface.

13. The method of claim 12, further comprising operating a compressor located in the annulus section of well casing between the tortuous flow path and the annular sealing device to augment the flow of gas in the annulus.

14. The method of claim 13, wherein the gas separation device comprises a flow tube which defines a flow path for the fluid flow, which path breaks relatively large gaseous portions into pluralities of small bubbles.

15. The method according to claim 14, wherein the flow tube is plugged at the upstream location, said flow tube provided with a plurality of tortuous apertures and internal baffles provide said tortuous flow path.

16. A system for homogenizing production fluid from an oil well having one or more wellbores and a flow tube for receiving fluids, the system comprising:

a) a gas/liquid separation device located in a vertical or horizontal section of well casing near a heel portion of a wellbore to separate gas from production fluid;

b) an annulus section formed around the flow tube in the vertical or horizontal section of well casing between the heel portion and an annular sealing device positioned downstream and arranged to receive the gas separated by the gas liquid separation device; and c) a nozzle in fluid communication with the vertical or horizontal section of the flow tube, the nozzle located upstream of the annular sealing device to inject gas bubbles in the liquid fluid in the flow tube.

17. The system of claim 16, wherein the gas/liquid separation device comprises a tortuous flow path.

18. The system of claim 17, wherein the tortuous flow path is defined by a spiral baffle.

19. The system of claim 17, wherein the tortuous flow path is defined by an auger.

20. The system of claim 17, wherein the tortuous path is defined by a flow tube, plugged at one end, and provided with a plurality of tortuous apertures in the wall of the flow tube, and internal baffles supported in the flow tube.

21. The system of claim 16, wherein the nozzle comprises at least one gas injection device.

22. The system of claim 17, further comprising a compressor located in the annulus of well casing between the gas/liquid separation device and the annular sealing device.

23. The system of claim 17, further comprising a pressure relief device operable to relieve pressure from the annulus through the annular sealing device, when the gaseous pressure exceeds a predetermined value.

24. A system for homogenizing production fluid from an oil well having one or more generally horizontal wellbores, the production fluid consisting of a liquid portion and a gas portion, the system comprising:

a) a gas/liquid separation device located in a vertical or horizontal section of well casing near a heel portion of a generally horizontal wellbore, the gas/liquid separation device defining a tortuous flow path for the production fluid, which tortuous flow path is adapted to separate a gas portion from the production fluid, while directing the liquid portion of the production fluid to a flow tube to flow toward surface;

b) an annulus section formed around the vertical or horizontal section of well casing between the fluid source and an annular sealing device positioned downstream of the fluid source, the annulus section being in fluid communication with the gas/liquid separation device for receiving the gas portion separated from the production fluid by the gas separation device; and c) a nozzle in fluid communication with the flow tube at a location upstream of the annular sealing device, said nozzle for directing relatively dispersed gas bubbles from the annulus to the flow tube in a controlled manner which homogeneously mixes the gas bubbles with the liquid portion.

25. The system according to claim 24, wherein the nozzle is adapted to inject the gas bubbles into the flow tube.

26. The system of claim 24, wherein the gas/liquid separation device comprises a spiral shaped baffle.

27. The system according to claim 26, wherein the gas/liquid separation device comprises an auger.

28. The system according to claim 26, wherein the gas/liquid separation device comprises a flow tube plugged or one end and provided with tortuous apertures and internal baffles supported therein.

29. The system according to claim 26, wherein the gas separation device comprises the flow tube plugged at the fluid receiving end, the flow tube defining a plurality of tortuous paths for the production fluid, the paths being configured to separate the gas portion from the production fluid, while permitting the liquid portion to flow in the flow tube toward surface and directing the gas portion to flow into the annulus.

30. The system of claim 24, wherein a pressure relief mechanism is positioned within, or in close proximity to the annular sealing device to relieve pressure from the annulus when the pressure exceeds a predetermined amount.

31. An apparatus for homogenizing production fluid from an oil well having at least one wellbore, comprising:

a flow tube positioned in a wellbore for directing a production fluid to a surface, said flow tube defining an annulus with the wellbore;

a flow tube positioned in a wellbore and defining an annulus with the wellbore;

a gas/liquid separation device adapted to be positioned in the flow tube for separating gaseous medium from liquid medium and including a conduit for directing the gaseous medium into the annulus;

an injector for injecting the gaseous medium in form of a plurality of small bubbles from the annulus into flow tube to be joined with the liquid medium in the flow tube to form a homogeneous mixture in the flow tube, said injector being located in the annulus downstream of an outlet of said conduit through which the gaseous medium enters the annulus.

32. The apparatus according to claim 31, wherein said injector comprises an injection nozzle.

33. The apparatus according to claim 31, wherein said gas/liquid separation device comprises a tortuous flow path.

34. The apparatus according to claim 33, wherein said tortuous flow path comprises a spiral baffle.

35. The apparatus according to claim 33, wherein said tortuous flow path comprises an auger which defines a spiral path.

36. The apparatus of claim 33, wherein said tortuous path is provided by a flow tube, plugged at the fluid receiving end and provided with baffles and tortuous apertures to separate a gaseous portion of the production flow from a liquid portion.

* * * * *